United States Patent [19]

Tietjens

[11] 4,044,463

[45] Aug. 30, 1977

[54] SHAVING APPARATUS WITH A HOLDER FOR A CUTTING ELEMENT

[75] Inventor: Eduard Willem Tietjens, Drachten, Netherlands

[73] Assignee: U.S. Philips Corporation, New York, N.Y.

[21] Appl. No.: 684,799

[22] Filed: May 10, 1976

[30] Foreign Application Priority Data

June 12, 1975 Netherlands ..... 7506985

[51] Int. Cl.[2] ..... B26B 21/22

[52] U.S. Cl. ..... 30/34.2; 30/50

[58] Field of Search ..... 30/34.2, 50, 346.57

[56] References Cited

U.S. PATENT DOCUMENTS

| | | | |
|---|---|---|---|
| 1, 579,844 | 4/1926 | Smith | 30/50 |
| 2,670,534 | 3/1954 | Haber | 30/34.2 |
| 3,871,073 | 3/1975 | Nissen | 30/34.2 |
| 3,872,588 | 3/1975 | Bogaty | 30/50 |

*Primary Examiner*—Jimmy C. Peters

*Attorney, Agent, or Firm*—Frank R. Trifari; Rolf E. Schneider

[57] ABSTRACT

A shaving apparatus comprises a holder having at least one cutting element, particularly intended for so-called wet-shaving, and a hair-pulling member including a blade shaped portion movable between the inside and the outside of the holder.

3 Claims, 6 Drawing Figures

SHAVING APPARATUS WITH A HOLDER FOR A CUTTING ELEMENT

This invention relates to a shaving apparatus with a holder for at least one cutting element.

Such a shaving apparatus is for example known from Netherlands Patent Application No. 72.03329. This apparatus is manually moved over the skin, the hairs being cut off by the cutting element approximately at the level of the skin surface. Generally, the hairs are previously made soft and supple by lathering.

It is an object of the invention to improve such apparatus so that the hairs can be shaved off even more closely. The improved embodiment is characterized in that it is provided with a hair-pulling member which is movable relative to the holder.

A preferred embodiment of such a shaving apparatus is characterized in that the hair-pulling member includes a blade shaped portion with a sharp edge which projects from the holder, the blade shaped portion being movable between the inside and the outside of the holder.

Such blade shaped portion of the hair-pulling member is advantageously given a greater angle of inclination relative to the skin-positioning surface of the apparatus than the cutting element.

This blade shaped portion is composed of a multiplicity of individual lamellar segments which are disposed in side-by-side relationship and which are independently movable relative to each other. These lamellar segments, as well as the balance of the hair-pulling member, may desirably be formed of electroplated metal.

The invention will be described in more detail with reference to the drawings in which FIG. 1 is a perspective view of a shaving apparatus with a hair-pulling member according to the invention.

Figure 1:
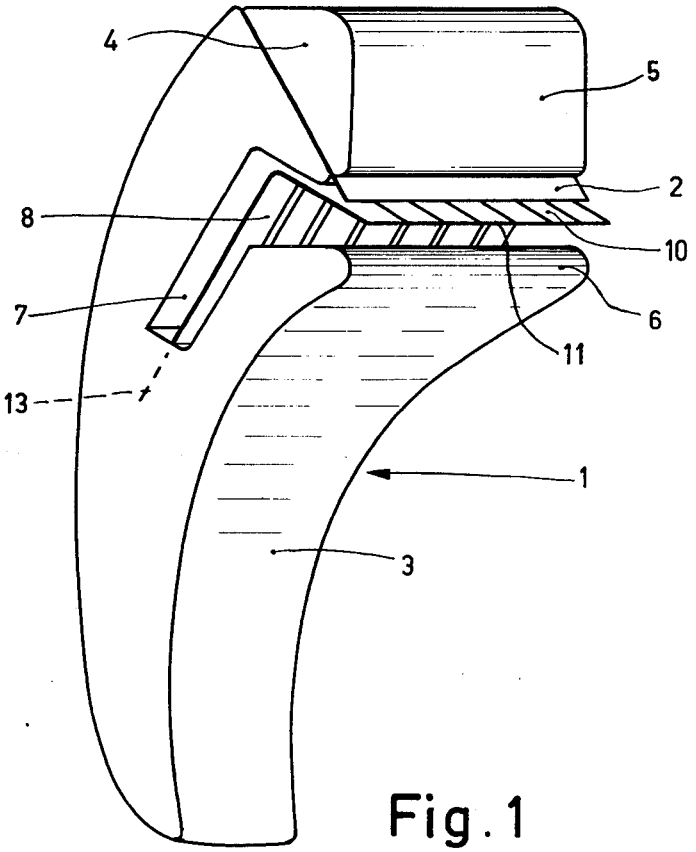
Figure 2:
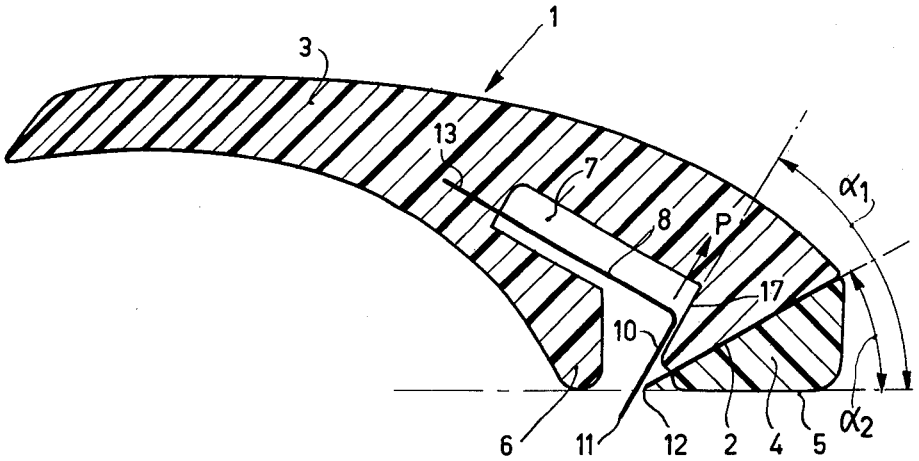
FIG. 2 is a cross-section of the apparatus of FIG. 1.

The shaving apparatus as shown in FIGS. 1 and 2 substantially comprises a holder 1 and a cutting element 2. The holder 1 comprises a handle 3 onto which the cutting blade 2 is clamped in known manner with the aid of the clamping piece 4. During use of the shaver the positioning surface 5 of the clamping piece 4 touches the skin, and also serves as a skin tightener. A second tightener is formed by the edge 6 of the handle 3.

Figure 3:
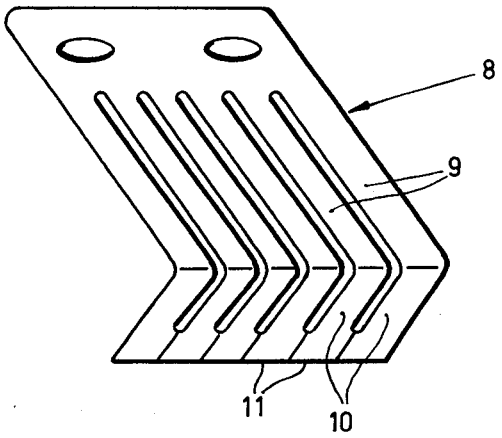
FIG. 3 shows the hair-pulling member separately.

In the cavity 7 in the handle 3 the hair-pulling member 8 is located. As can be seen in FIG. 3 this blade-shaped hair-pulling member 8 is divided into the side-by-side lamellae 9 which at their ends are formed with a perpendicularly bent lamellar portion 10. The sharp edge 11 of the perpendicularly bent lamellar portions 10 is located near the cutting edge 12 of the cutting blade 2, but projects slightly further from the holder. The hair-pulling member 8 is only secured in the handle 3 at its end 13 and the lamellae 9 have elastic or resilient properties, with the result that the perpendicularly bent lamellar portions 10 can move between the inside and the outside of the holder.

Figure 4:
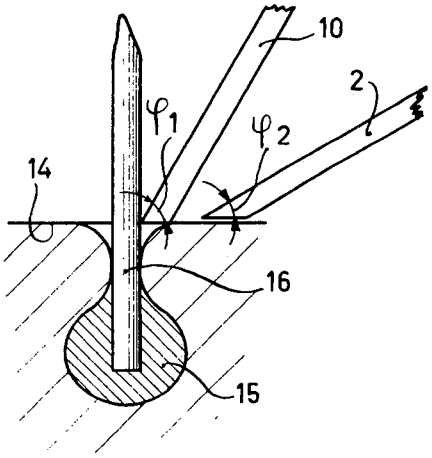
FIGS. 4 through 6 illustrate the operation of the hair-pulling member for a single hair.
Figure 5:
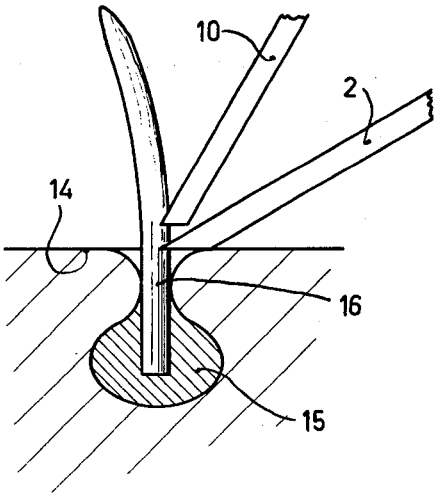
Figure 6:
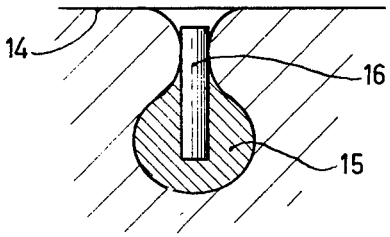

When the shaving apparatus is applied to the skin the lamellar portions 10 are pressed inwards approximately in a direction as indicated by the arrow P until the sharp edge 11 is disposed at the level of the surface 5. The shape and dimensions of the hair-pulling member are such that the hair-pulling member then exerts very small forces on the skin which are not or are hardly noticed by the user. When the shaver is moved over the skin and a lamellar portion 10 meets a hair, the hair will exert a force on the lamellar portion 10, so that this lamellar portion 10 is moved further in the direction P. Its sharp edge 11, however, has penetrated the hair so that the hair is pulled along. As the movement of the shaver along the skin continues the cutting blade 2 will cut the hair with the cutting edge 12 at a location which is normally disposed underneath the local skin surface. In FIGS. 4 through 6 this is illustrated in detail. In these Figures, 14 represents the skin surface with the hair 16 in a follicle 15. Of the shaver only a lamellar portion 10 of the hair-pulling member and the cutting blade 2 are shown.

In order to allow penetration into the hair the hair-pulling member should have a sharp edge, which however should not cut off the hair. This is achieved by arranging the hair-pulling member at an angle of inclination $\alpha$ 1 relative to the surface 5 which is larger than the angle of inclination $\alpha$ 2 of the cutting element 2 and by designing the hair-pulling member so that the forces which are necessary to move such member are small (see FIG. 2). Moreover, the cutting angle $\phi$ 1 of the lamellar portions 10 will generally be more obtuse than the cutting angle $\phi$ 2 of the cutting blade 2 (FIGS. 4 and 5).

It is possible to guide the movement of the lamellar portions 10 for example by making said portions engage with the wall 17 of the holder 3.

By providing the hair-pulling member with a multiplicity of individual side-by-side lamellae 9 of small width, the risk that a lamellar portion 10 meets several hairs at the same time is reduced.

The lamellae 9 provide a resilient support for the respective lamellar portions 10. Obviously, a different support of the lamellar portions 10 is possible, for example by means of spiral springs.

The hair-pulling member described hereinbefore can be employed in all so-called wet-shaving apparatus, i.e. those shaving apparatus for which the hairs are previously made soft and supple by lathering. In the known embodiment of such an apparatus with a cutting blade having a cutting edge at both sides, it is also possible to provide a hair-pulling member at both sides.

What is claimed is:

1. A shaving apparatus comprising a holder, a cutting element fixedly positioned in said holder, and a hair-pulling member mounted at one end in said holder in proximity to said cutting element, said hair-pulling member being resilient and having at its other end a blade shaped portion normally projecting further from the holder than the cutting member, said blade shaped portion being composed of a plurality of individual lamellar segments disposed in side-by-side relationship and independently movable relative to each other, and said blade shaped portion being adapted in use to move into and out of said holder.

2. A shaving apparatus according to claim 1, in which the holder has a skin-positioning surface adjacent the cutting element and the blade shaped portion of the hair-pulling member, and in which the the angle of inclination of said blade shaped portion to said surface is greater than the angle of inclination of said cutting element of said surface.

3. A shaving apparatus according to claim 1, in which the cutting angle of the individual lamellar segments is more obtuse than the cutting angle of the cutting element.

* * * * *